US007434393B2

(12) United States Patent
Hesse

(10) Patent No.: US 7,434,393 B2
(45) Date of Patent: Oct. 14, 2008

(54) CONTROL SYSTEM AND METHOD FOR SUPPLYING PRESSURE MEANS TO AT LEAST TWO HYDRAULIC CONSUMERS

(75) Inventor: Horst Hesse, Stuttgart (DE)

(73) Assignee: Bosch Rexroth AG, Stuttgart (DE)

( * ) Notice: Subject to any disclaimer, the term of this patent is extended or adjusted under 35 U.S.C. 154(b) by 143 days.

(21) Appl. No.: 10/570,157

(22) PCT Filed: Sep. 9, 2004

(86) PCT No.: PCT/DE2004/002008

§ 371 (c)(1),
(2), (4) Date: Aug. 2, 2006

(87) PCT Pub. No.: WO2005/024245

PCT Pub. Date: Mar. 17, 2005

(65) Prior Publication Data

US 2007/0006580 A1 Jan. 11, 2007

(30) Foreign Application Priority Data

Sep. 11, 2003 (DE) ..... 103 42 037

(51) Int. Cl.
*F15B 11/16* (2006.01)
*F15B 21/08* (2006.01)

(52) U.S. Cl. ..... 60/422; 60/484; 91/517

(58) Field of Classification Search ..... 60/422, 60/445, 450, 452, 484; 91/436, 517
See application file for complete search history.

(56) References Cited

U.S. PATENT DOCUMENTS 5,065,664 A * 11/1991 Ohta et al. ..... 91/436
5,209,063 A * 5/1993 Shirai et al. ..... 60/484
5,271,227 A * 12/1993 Akiyama et al. ..... 60/484
5,273,069 A * 12/1993 Akiyama et al. ..... 60/452
5,279,122 A * 1/1994 Shirai et al. ..... 60/452
5,535,663 A * 7/1996 Yamashita et al. ..... 91/517
6,209,322 B1 * 4/2001 Yoshida et al. ..... 60/452

(Continued)

FOREIGN PATENT DOCUMENTS

DE 35 46 336 A1 7/1987

(Continued)

OTHER PUBLICATIONS

Hans Esders, "Olhydraulik und Pneumatik", vol. 38, No. 8, pp. 473-480, 1994.

*Primary Examiner*—Thomas E Lazo
(74) *Attorney, Agent, or Firm*—Oliff & Berridge, PLC

(57) ABSTRACT

Disclosed are a control arrangement and a method for the pressure medium supply of at least two hydraulic consumers that are supplied with pressure medium through the intermediary of a variable displacement pump. In the pressure medium flow path between the consumers and the variable displacement pump a respective meter-in orifice is provided. An adjustment of the variable displacement pump and of the meter-in orifices takes place electronically through the intermediary of a control means in dependence on the target values input by an operator. In accordance with the invention, the meter-in orifice associated with the consumer having the highest load pressure is controlled to open completely, so that the pressure loss across this meter-in orifice is minimum.

8 Claims, 4 Drawing Sheets

U.S. PATENT DOCUMENTS

| | | | | |
|---|---|---|---|---|
| 6,367,365 | B1 * | 4/2002 | Weickert et al. | 91/447 |
| 6,422,009 | B1 * | 7/2002 | Nozawa et al. | 60/447 |
| 6,438,953 | B1 * | 8/2002 | Kamada | 91/517 |

FOREIGN PATENT DOCUMENTS

| | | | |
|---|---|---|---|
| DE | 36 44 736 | A1 | 7/1988 |
| DE | 100 27 382 | A1 | 12/2001 |
| EP | 0 275 969 | | 7/1988 |
| EP | 0 587 902 | A1 | 3/1994 |
| EP | 0 796 952 | A1 | 9/1997 |
| EP | 0 972 138 | B1 | 1/2000 |
| WO | WO 93/01417 | | 1/1993 |

* cited by examiner

CONTROL SYSTEM AND METHOD FOR SUPPLYING PRESSURE MEANS TO AT LEAST TWO HYDRAULIC CONSUMERS

The invention relates to a control arrangement for the pressure medium supply of at least two hydraulic consumers and a method for controlling such consumers.

In order to actuate several consumers, hydraulic systems are employed in which the consumers are supplied with pressure medium through the intermediary of a pump having a variable capacity (variable displacement pump). Between the variable displacement pump and each consumer a meter-in orifice and a pressure compensator are frequently provided, wherein the latter may be arranged upstream or downstream from the meter-in orifice. Here one differentiates between LS (load-sensing) systems operating according-to the flow regulator principle and systems operating according to the flow divider principle, where the pressure compensator is always arranged downstream from the meter-in orifice. These flow divider systems are also referred to as systems with load-independent flow distribution load independent flow distribution LUDV), which constitute a subgroup of the LS systems. In the LS systems, the variable displacement pump is adjusted in dependence on the highest load pressure of the actuated hydraulic consumers, such that the supply pressure is higher than the highest load pressure by a specific pressure difference.

In LUDV systems, the pressure compensators arranged downstream are subjected to the pressure downstream from the respective meter-in orifice in the opening direction, and to a control pressure which usually corresponds to the highest load pressure of all the actuated consumers in the closing direction. If, upon concurrent actuation of several hydraulic consumers, the meter-in orifices are opened to such an extent that the quantity of pressure medium supplied from the hydraulic pump adjusted to the limit is smaller than the total demanded quantity of pressure medium, the quantities of pressure medium flowing to the single hydraulic consumers are reduced proportionally, independently of the respective load pressure of the hydraulic consumers (load-independent flow distribution).

In systems operating in accordance with the flow regulator principle, the pressure compensator arranged upstream or downstream from the meter-in orifice is subjected to the pressure upstream from the meter-in orifice in the closing direction, and to the individual load pressure of the respective hydraulic consumer in the opening direction, whereby a load-independent flow distribution is not obtained. If several hydraulic consumers are actuated simultaneously while not being supplied with a sufficient quantity of pressure medium delivered from the variable displacement pump, only the quantity of pressure medium flowing to the hydraulic consumer having the highest load pressure is reduced.

Such a control arrangement is disclosed, e.g., in EP 0 972 138 B1, wherein the pressure compensators are arranged upstream from the meter-in orifices. In DE 100 27 382 A1 a LS control arrangement is represented wherein the pressure compensators are arranged downstream from the meter-in orifices.

In all of the above described LS/LUDV systems, the variable displacement pump is driven in dependence on the highest load pressure that is tapped via a LS line, so that a pressure manifests in the pump line which is higher than the highest load pressure by a pressure difference equivalent to the force of a control spring of a pump control valve. In the periodical O+P "oil hydraulics and pneumatics" 38 (1994), No. 8, pp. 473 et seq., a so-called electro-hydraulic LS system is described in which the regulation of the pump setting is performed electronically. Among others, the pressures acting on the consumers, the pump pressure, the drive speed, and the drive torque of the variable displacement pump are detected by sensors, and actuation signals are output in dependence, e.g., on target values predetermined through the intermediary of a joystick to the pump regulating valve and the proportional valves arranged upstream from the consumers. In this known electro-hydraulic system, the function of the individual pressure compensators associated with the meter-in orifices is realized electronically.

In this solution, too, the pump pressure is adjusted such that is exceeds the highest load pressure by a predetermined pressure difference, so that corresponding system losses may occur in this type of actuation.

In EP 0 275 969 B1 an electro-hydraulic LS control arrangement is shown where the individual pressure compensators are arranged upstream from the meter-in orifices. In this known method, the target values set for the meter-in orifices through the intermediary of actuators, e.g., joysticks, are detected and a total flow rate is determined from them. Driving the variable displacement pump then takes place such that a slight insufficient supply manifests, so that the meter-in orifice of the consumer having the highest load pressure is opened, and thus the above mentioned pressure difference between the pump pressure and the highest load pressure is reduced. Due to this insufficient supply, however, the actuation velocity of the consumers is reduced.

From DE 35 46 336 C2 and DE 36 44 736 A1 electro-hydraulic LS systems are known in which the total flow rate is determined either from the deflections of the directional control valves constituting the meter-in orifices or from the settings of the target value entry means (joystick), and this cumulative flow rate is compared with a maximum capacity of the pump. In a case in which more capacity is requested, the strokes of all of the actuated directional control valves are electrically reduced to such a degree that the respective flows are reduced proportionally, and thus the adjusted trajectory of the actuated consumers is preserved at a reduced actuation velocity.

In these solutions, as well, a pressure loss corresponding to the difference between the pump pressure and the individual load pressure manifests at the meter-in orifice of consumer subjected to the highest load.

In contrast, the invention is based on the object of further developing a control arrangement and a method for the pressure medium supply of at least two hydraulic consumers in such a way that an actuation of several consumers with a predetermined velocity at reduced energy losses is enabled.

This object is achieved in terms of the control arrangement through the features of claim 1, and in terms of the method through the features of claim 6.

In accordance with the invention, the individual load pressures of the consumers are detected through suitable sensors, and from these signals the consumer having the highest load pressure is determined. The meter-in orifice associated with the consumer having the highest load pressure is controlled open completely by the setting resulting from the preset target value, so that the pressure loss across the meter-in orifice associated with the consumer having the highest load is minimum. In the event of a sufficiently accurate harmonization between the pressure medium flow rates through the meter-in orifices predetermined by the target values and the capacity, only a minimum pressure difference is caused at the meter-in orifice of the consumer having the highest load. In a case in which an individual pressure compensator is associated with this meter-in orifice, the latter is also opened completely, for even a slight excess quantity of the pressure medium flow rate delivered by the pump is not suited to generate, at the completely opened meter-in orifice, a pressure drop capable of adjusting the pressure compensator in the closing direction against the force of a control spring associated with the latter.

The control arrangement of the invention, or the method of the invention, may be employed in control arrangements where the individual pressure compensators are arranged upstream or downstream from the meter-in orifices.

In a case in which the control arrangement in accordance with the invention is executed with another sensor for detection of the system pressure, i.e., the pressure upstream from the meter-in orifices, the pressure difference across the respective meter-in orifices may be determined with the aid of the signals detected by the pressure sensors. The meter-in orifices are then adjusted by means of the electronic equipment of the control arrangement such that the desired pressure medium flow rate flows to the consumers. I.e., in such a variant the function of the individual pressure compensators is realized electronically, in which case, however, in contrast with the literature (O+P) mentioned at the outset, the meter-in orifice of the consumer having the highest load pressure is always opened completely, so that the energy losses are reduced in comparison with the known solution.

As an alternative for the above described solution where the function of the individual pressure compensators is realized by software, the control arrangement may be executed with individual pressure compensators arranged upstream or downstream from the meter-in orifices, that are each subjected to the pressure upstream from the meter-in orifice in the closing direction, and to the pressure downstream from the meter-in orifice in the opening direction.

In the variant where the pressure compensators are arranged downstream from the meter-in orifices, there results a structure similar to that of LUDV directional control valves. This makes it possible to provide identical or at least similar housings as semi-finished products for the control arrangement in accordance with the invention and LUDV control arrangements, so that the manufacturing costs may be reduced.

In the case of a pulling load, it is possible to detect this by means of the sensors used in accordance with the invention and to throttle down the variable displacement pump, and the pressure medium may be replenished to the low-pressure side of the consumers via anti-cavitation valves.

By the method in accordance with the invention, in the case of a insufficient supply the flow passages of the meter-in orifices associated with the consumers having lower loads may be reduced proportionally. This reduction preferably takes place with the ratio of the maximum pump capacity to the desired target quantity.

In a practical example of the method of the invention, the load pressures of simultaneously actuated consumers are compared, and in a case in which these load pressures differ by less than the regulating $\Delta p$ of the pressure compensators, the meter-in orifice of the consumer having a lower load is opened further than predetermined by the target value, so that this pressure difference is compensated.

Further advantageous developments of the invention are subject matter of further subclaims.

In the following, preferred practical examples of the invention shall be explained in more detail by referring to schematic drawings, where:

Figure 1:
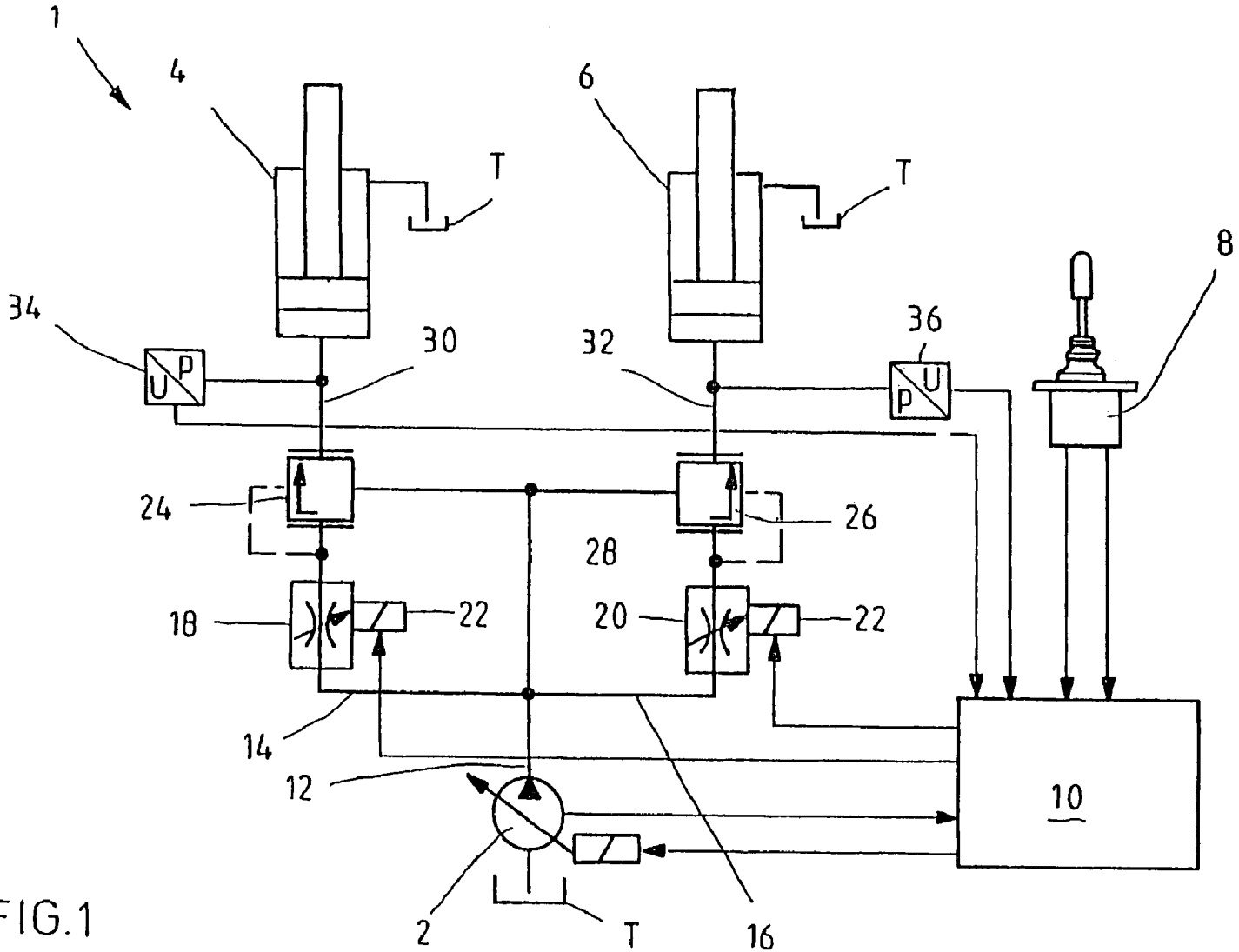
FIG. 1 shows a control arrangement in accordance with the invention, with individual pressure compensators arranged downstream from the meter-in orifices.

The control arrangement 1 represented in FIG. 1 operates in accordance with the flow regulator principle where several flow regulators are arranged in parallel. The represented control arrangement 1 has a variable displacement pump 2 whereby two or more consumers 4, 6 may be supplied with pressure medium. Their actuation takes place, e.g., with the aid of a control device, for instance a joystick 8, whereby control signals are output to electronic control means 10. These signals constitute a command to displace the consumers at a particular velocity and along a particular movement path.

The outlet from the variable displacement pump 2 is connected to a pump line 12 branching into two supply lines 14, 16. In each supply line 14, 16 a respective meter-in orifice 18 or 20 is arranged which may electronically be adjusted proportionally and which may be adjusted through the intermediary of a proportional magnet 22 driven by the control means 10.

The meter-in orifices 18, 20 formed, e.g., by proportional valves are each followed by a pressure compensator 24 or 26, respectively, which is subjected in the opening direction to the force of a control spring and to the pressure downstream from the meter-in orifices 18, 20, and which is subjected in the closing direction to the pump or system pressure tapped from the pump line 12 via a branched control line 28.

The outlets of the pressure compensators 24, 26 are connected via a respective delivery line 30 and 32 with the consumers 4, 6. In the present case, these consumers 4, 6 are hydraulic cylinders, the cylinder chambers of which are coupled to the respective delivery line 30 and 32. In the hydraulic circuit diagram in accordance with FIG. 1, for the sake of simplicity the return and drain lines connecting the cylinder chambers with the tank T have been omitted, whose cross-sections of flow are equally controlled to open or close through the intermediary of the proportional valve forming the meter-in orifice 18, 20.

In accordance with the invention the load pressures of the consumers 4, 6 are detected and the settings of the meter-in orifices 18, 20 are altered in dependence on these load pressures. In the represented practical example, these load pressures are detected by pressure sensors 34, 36 which are arranged in the delivery lines 30, 32 and the signals of which are processed by the control means 10. In accordance with the representation in FIG. 1, the pressure sensors 34, 36 as well as the joystick 8 are connected via signal lines with the control means 10, whereby control signals are then output via signal lines to the electrically actuated pump regulating valve as well as the two proportionally adjustable meter-in orifices 18, 20 in accordance with the predetermined target values and the detected load pressures.

Instead of a variable displacement pump having a variable swivel angle, it is, for instance, also possible to use a fixed displacement pump having a variable-speed drive mechanism.

The variable displacement pump 2 is preferably executed with a pressure sensor for detecting the pump pressure, a speed sensor for detecting the pump speed, and a swivel angle sensor for detecting the swivel angle of the pump. Inside the control means the characteristics of the variable displacement pump 2 and of the two proportionally adjustable meter-in orifices 18, 20 are moreover stored, so that with the aid of all, or some of, the above mentioned sensors and-of the characteristics, an extremely accurate flow rate control by means of the variable displacement pump 2 is possible. The operation of the control arrangement in accordance with the invention is as follows.

In order to actuate the two consumers 4, 6, control signals are generated by the operator with the aid of one or more joysticks 8 and output to the control means 10. For correspondingly actuating the consumers 4, 6, the variable displacement pump 2 has to provide a particular pressure medium flow rate corresponding to the sum of the target flow rates adjusted by means of the joystick 8. In other words, the variable displacement pump 2 must be adjusted, in dependence on the adjustment of the joystick 8, to a swivel angle at which this cumulative flow rate is delivered. The corresponding adjustment of the variable displacement pump 2 may in a simple manner be achieved in dependence on the target value by detecting the current pump pressure, the current pump speed, and the adjusted swivel angle with the aid of the pump characteristic.

In accordance with the invention, the pump controller thus does not receive a pressure signal that corresponds, as a rule, to the highest load pressure, but actuation of the variable displacement pump 2 is performed solely in dependence on the target values. This does away with the necessity of tapping the load pressures via complex shuttle valve arrangements at the consumers and conducting them via comparatively long lines to the variable displacement pump 2.

Thanks to the target value adjustment with the aid of the joystick 8 it is possible to compensate flow rate errors occurring as a result of volumetric losses of the variable displacement pump 2, for the operator will immediately perform a readjustment with the aid of the joystick 8 if the consumers 4, 6 are not actuated at the desired velocity. The highest load pressure then accordingly manifests at the consumer subjected to the highest load, and the pressure difference from the consumers subjected to lower loads is throttled away by a flow control at the individual pressure compensators 24, 26.

In accordance with the invention, the one consumer at which the highest load pressure is present is determined by way of the pressure sensors 34, 36. To this end, the signals detected by the pressure sensors 34, 36 are compared to each other in the control means 10, and a control signal is output to the one meter-in orifice 18, 20 associated to the consumer 4, 6 having the highest load pressure, whereby this meter-in orifice 18, 20 is opened fully. Then only a minimum pressure difference is caused at this meter-in orifice 18, 20, so that the system losses are reduced in comparison with the control options described at the outset. The associated pressure compensator 24 or 26 of the respective consumer 4 or 6 having the highest load pressure is then also opened completely, for the pressure difference across the associated meter-in orifice 18 or 22 is not sufficient for adjusting the pressure compensator in the closing direction against the force of the control spring.

In the practical example represented in FIG. 1, the flow regulation arrangement is executed with the pressure compensators 24, 26 arranged downstream from the meter-in orifices 18, 20. As the pressure compensators must always be arranged downstream from the meter-in orifices in the LUDV systems described at the outset, identical housings or housings only slightly modified may be used for the system represented in FIG. 1 and for LUDV systems.

Figure 2:
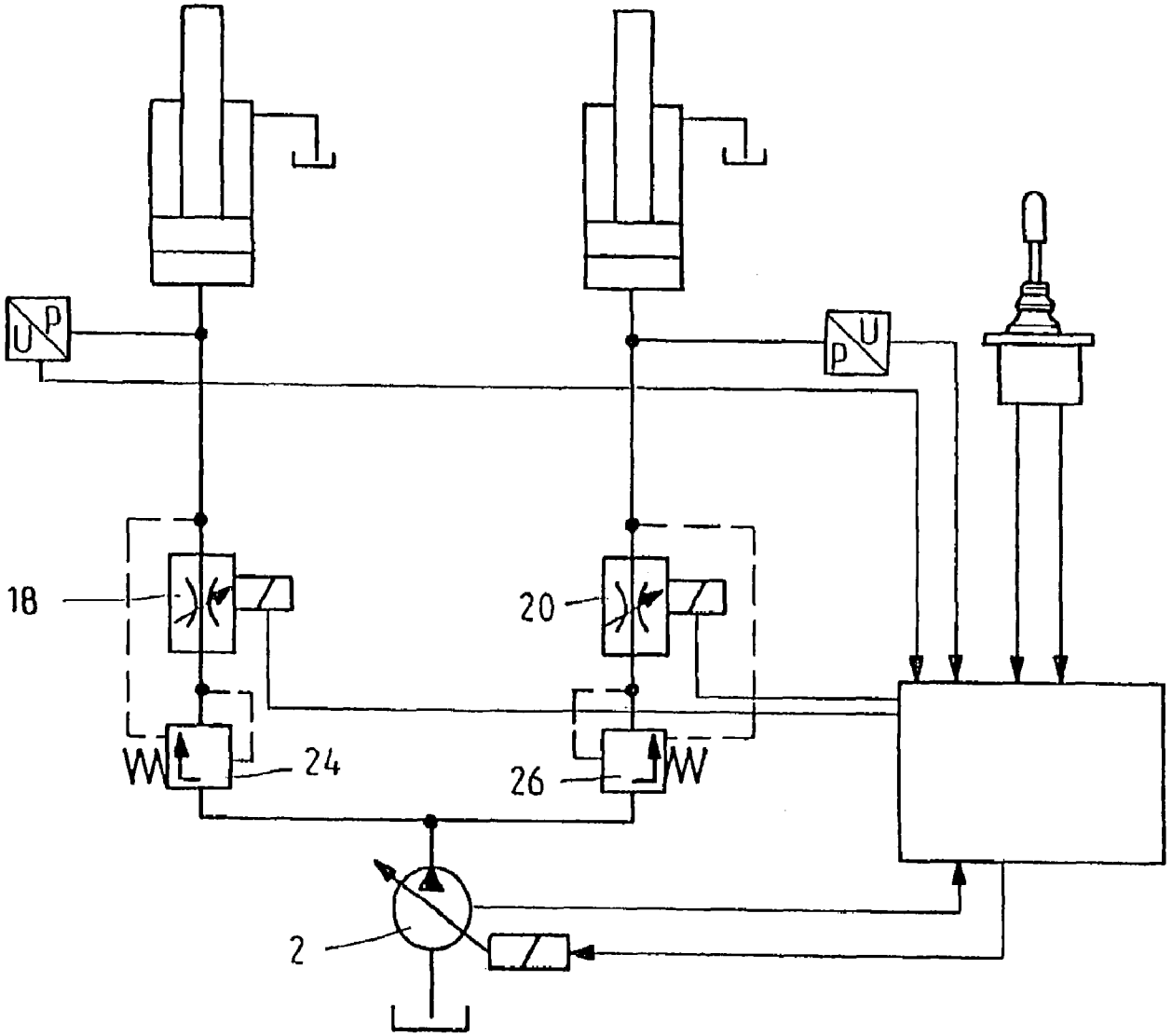
FIG. 2 shows a variant of the control arrangement of FIG. 1, with an upstream individual pressure compensator.

As is indicated in FIG. 2, the control arrangement in accordance with the invention may also be realized in control arrangements where the individual pressure compensators 24, 26 are arranged upstream from the meter-in orifices 18 and 20. These pressure compensators are also subjected in the opening direction to the pressure downstream from the meter-in orifices 18, 20, and in the closing direction to the pressure upstream from the meter-in orifices 18, 20, i.e., to the pump pressure delivered by the variable displacement pump 2. The remaining structure and the function of the control arrangement represented in FIG. 2 correspond to the practical example in accordance with FIG. 1, so that additional explanations are not necessary.

Figure 3:
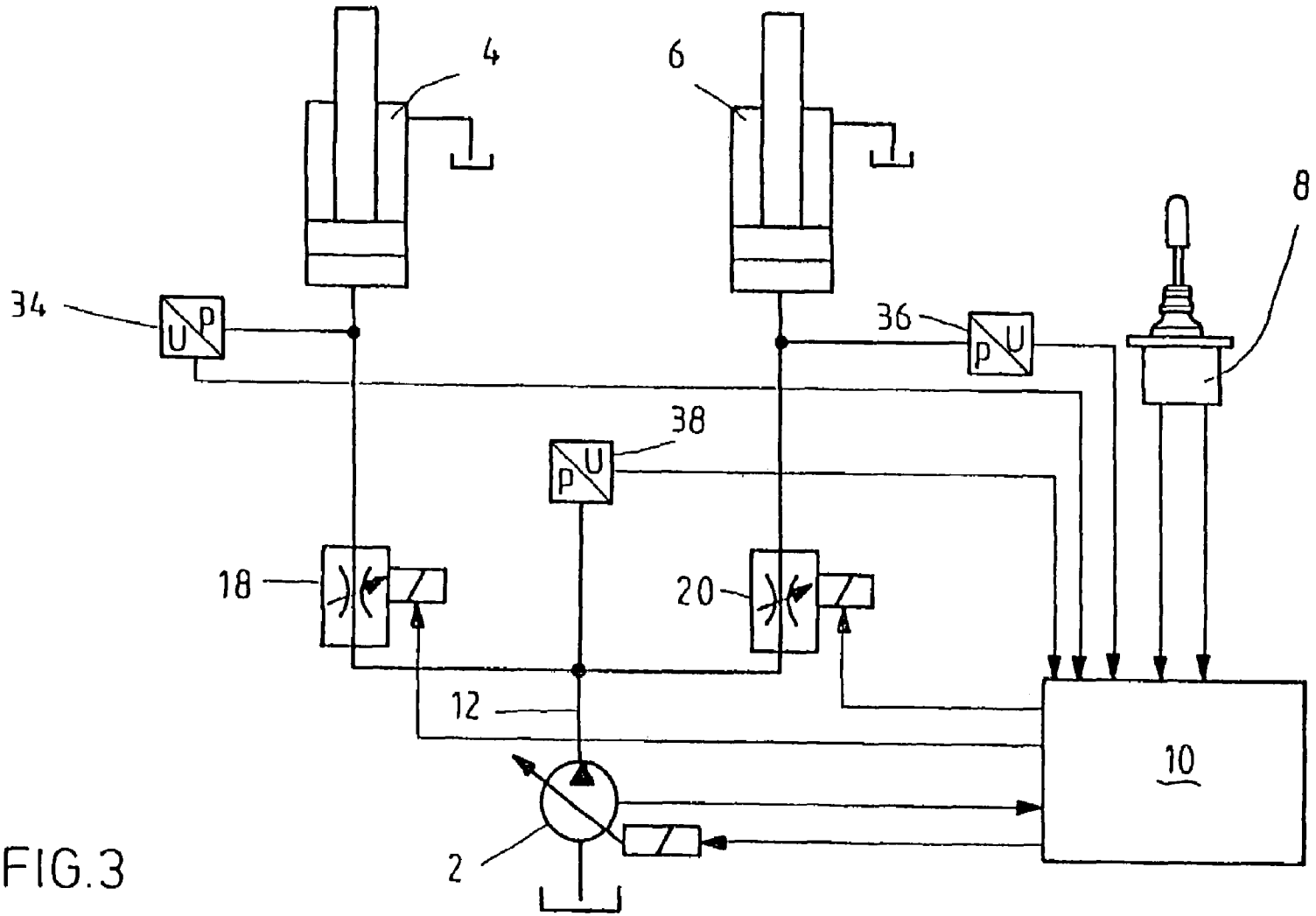
FIG. 3 shows a control arrangement where the function of the individual pressure compensators is realized electronically.

In FIG. 3 a variant is represented where no individual pressure compensators are associated to the meter-in orifices 18, 20. In this practical example, the function of the individual pressure compensators is practically taken over by the electronic equipment. To this end, the pressure in the pump line 12, i.e., the pressure upstream from the meter-in orifices 18, 20, must be detected by an additional pressure sensor 38. It is then possible to calculate the pressure drop across the meter-in orifices 18, 20 from this pressure and from the pressures downstream from the meter-in orifices 18, 20 that are detected by the pressure sensors 34, 36. Having knowledge of these pressure losses across the meter-in orifices 18, 20, the cross-section of flow of the respective meter-in orifices 18, 20 may then be adjusted through the control means 10 with the aid of the stored characteristic lines, such that the desired flow rate flows to the consumers 4, 6. The adjustment of the variable displacement pump 2 is performed in the above described manner in-dependence on the target values set through the joystick 8.

The above described systems differ from the previously known LS systems in that the variable displacement pump is adjusted to the desired cumulative flow, and the single pressure medium flows to the consumers are divided up by suitable control of the valve orifices, wherein the meter-in orifice associated with the consumer having the highest load pressure is controlled to open completely.

Such a control arrangement makes it possible, e.g., in the case of insufficient supply, i.e., in a case in which the target quantity is greater than the maximum pump quantity, to proportionally reduce the flows passing through the meter-in orifices of the consumers having lower load pressures. I.e., by the control arrangement in accordance with the invention it is practically possible to achieve a LUDV behavior in that the opening cross-sections of the meter-in orifices 18, 20 having lower load pressures are reduced. This reduction may, e.g., take place at the ratio of the maximum pump capacity to the target quantity. This shall be explained by way of an example where the control arrangement of the invention is realized for actuating three consumers. It shall furthermore be assumed that the target flows at the three consumers set through joysticks 8 are 40, 60 and 20 liters/minute, i.e., the target cumulative flow rate is 120 liters/minute, where the consumer having the highest load pressure is to be supplied with 20 liters/minute. The maximum capacity of the pump is, e.g., 100 liters/minute—which is an insufficient supply. This insufficient supply is compensated, in accordance with the invention, in that the target values for the two consumers having lower loads (40, 60 liters/minute) is reduced through the intermediary of the control means 10 at the ratio of the maximum capacity of the pump to the cumulative flow rates, i.e., at a ratio of 100/120. In other words, the consumer named first is supplied with 33.33 liters/minute, the consumer named second with 50 liters/minute (per time unit). The meter-in orifice of the consumer having the highest load pressure is controlled fully open in accordance with the invention—the manifesting flow rate across this meter-in orifice is 16.66 liters/minute, so that the maximum capacity of the pump, being 100 1/min., is divided at an identical ratio and thus a load-independent flow distribution (LUDV) is realized in practice.

In a case in which a pulling load is acting (such as in downhill travel), this may be detected through the pressure sensors 34, 36, and the pump may be regulated down accordingly. Replenishing on the low-pressure side of the consumers 4, 6 then takes place via anti-cavitation valves from the high-pressure side. In other words, in comparison with presently usual control arrangements, the losses in the case of a pulling load may be reduced further.

Particularly the practical examples explained by reference to FIGS. 1 and 2 are characterized by a low susceptibility to vibration.

The target values may, instead of the electric joystick 8, even in the case of proportional valves provided with spool stroke measurement, be determined from the actual spool stroke value of the meter-in orifices 18, 20.

The system in accordance with the invention is, of course, also effective when only a single consumer is actuated—in this case, the meter-in orifice of this consumer is controlled to open completely, and the pressure medium flow rate is controlled through the variable displacement pump 2.

Figure 4:
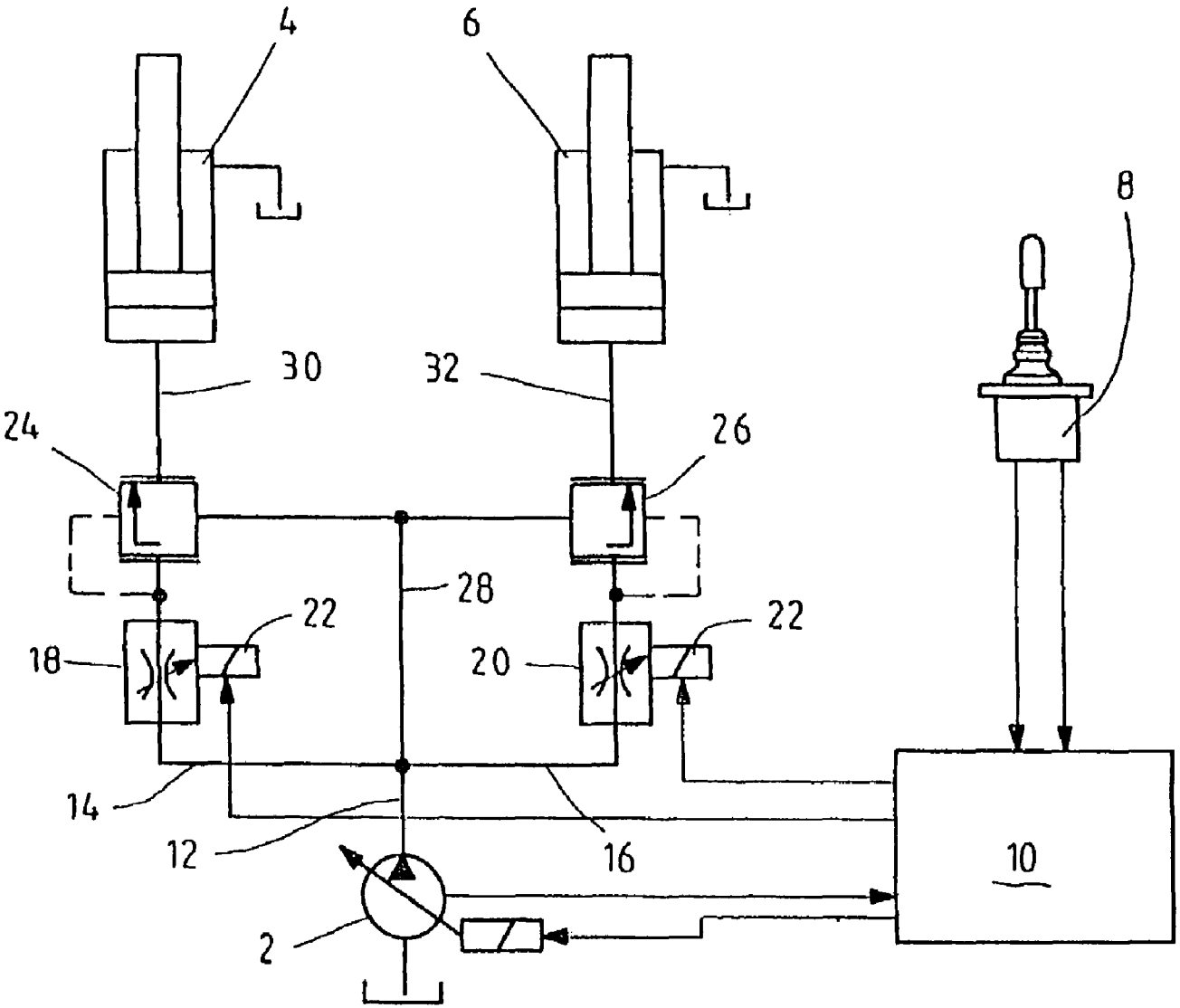
FIG. 4 shows a control arrangement with individual pressure compensators arranged downstream from the meter-in orifices.

FIG. 4 shows a control arrangement where the individual load pressures of the consumers 4, 6 are not detected by means of pressure sensors or the like. This is in turn a flow regulation system in which the two individual pressure compensators 24, 26 are arranged downstream from the two proportionally adjustable meter-in orifices 18, 20. In other words, apart from the fact that the two sensors 34, 36 are not provided, the control arrangement represented in FIG. 4 corresponds to the one of FIG. 1. In the control arrangement in accordance with FIG. 4, as well, the variable displacement pump 2 is adjusted as a function of the target values set through the intermediary of the joystick 8 such that it delivers the desired cumulative pressure medium flow. Dividing of this cumulative pressure medium flow then is effected by means of the flow regulators (meter-in orifices 18, 20; pressure compensators 24, 26), with the meter-in orifices 18, 20 again being adjusted as a function of the target values set at the joystick 8. By means of the individual pressure compensators 24, 26 the load pressure present at the outlet of the meter-in orifices 18, 20, which about corresponds to the highest effective load pressure of the consumers, is throttled to the individual load pressures. As a difference from the above described practical example, however, the meter-in orifice associated with the consumer having the higher load pressure remains at the opening cross-section set as a function of the predetermined target value and is not controlled open completely.

Disclosed are a control arrangement and a method for the pressure medium supply of at least two hydraulic consumers that are supplied with pressure medium through the intermediary of a variable displacement pump. In the pressure medium flow path between the consumers and the variable displacement pump a respective meter-in orifice is provided. An adjustment of the variable displacement pump and of the meter-in orifices takes place electronically through the intermediary of a control means in dependence on the target values input by an operator. In accordance with the invention, the meter-in orifice associated with the consumer having the highest load pressure is controlled to open completely, so that the pressure loss across this meter-in orifice is minimum.

LIST OF REFERENCE SYMBOLS

1 control arrangement
2 variable displacement pump
4 consumer
6 consumer
8 joystick
10 control means
12 pump line
14 supply line
16 supply line
18 meter-in orifice
20 meter-in orifice
22 proportional magnet
24 pressure compensator
26 pressure compensator
28 control line
30 delivery line
32 delivery line
34 pressure sensor (load pressure)
36 pressure sensor (load pressure)
38 pressure sensor (pump pressure)

The invention claimed is:

1. A control arrangement for the pressure medium supply of at least two hydraulic consumers, comprising a variable displacement pump arrangement which has a variable capacity, and comprising at least two adjustable meter-in orifices each associated with a respective one of the consumers and respectively adjustable in dependence on a target value set at a target value entry means through the intermediary of a control means, and comprising a means outputting a control signal to the variable displacement pump in dependence on the set target values, characterized by respective sensors provided in the pressure medium flow paths downstream from the meter-in orifices for detecting the individual load pressures, by a means for detecting the consumer having the highest load pressure based on the signals detected by the sensors and for controlling open the meter-in orifice associated with the consumer having the highest load pressure, wherein upstream or downstream from each meter-in orifice a pressure compensator is arranged which is subjected in the closing direction to the pressure upstream from the meter-in orifice, and in the opening direction to the pressure downstream from the associated meter-in orifice.

2. The control arrangement in accordance with claim 1, wherein an additional sensor is provided for detecting the pressure upstream from the meter-in orifices, and wherein the pressure drop across the meter-in orifices is determined with the aid of the means from the detected signals, and the actuation of the meter-in orifices is variable in dependence on this pressure drop, so that a desired pressure medium flow rate flows to the consumers.

3. The control arrangement in accordance with claim 1, wherein the target value entry means is at least one joystick.

4. A method for actuating a control arrangement for the pressure medium supply of at least two hydraulic consumers, comprising a variable displacement pump arrangement which has a variable capacity, and comprising at least two adjustable meter-in orifices each associated with a respective one of the consumers and respectively adjustable in dependence on a target value set at a target value entry means through the intermediary of a control unit, and comprising a means outputting a control signal to the variable displacement pump in dependence on the set target values, characterized in that the individual load pressures of the consumers are detected, and the meter-in orifice associated with the consumer having the highest load pressure is controlled to open completely, wherein upstream or downstream from each meter-in orifice a pressure compensator is arranged which is subjected in the closing direction to the pressure upstream from the meter-in orifice, and in the opening direction to the pressure downstream from the associated meter-in orifice.

5. The method in accordance with claim 4, wherein a pressure upstream from the meter-in orifices is detected, and from this the pressure drop across the respective meter-in orifices and the individual load pressures is determined, and the setting of said meter-in orifices is varied such that a desired pressure medium flow rate distribution across the meter-in orifices is established.

6. The method in accordance with claim 4, wherein in the case of an insufficient supply the cross-sections of flow of the meter-in orifices associated with the consumers having the lower load pressure are reduced, preferably at the ratio of the maximum pump capacity to the target cumulative flow rate.

7. The method in accordance with claim 4, wherein a pulling load is recognized by evaluating the signals detected by the sensors, and the variable displacement pump is regulated down accordingly.

8. The method in accordance with claim 4, wherein in the case of a concurrent actuation of several consumers, their load pressures are compared, and in the case of a differential load pressure being less than a control $\Delta p$ of the pressure compensator, the meter-in orifice associated with the consumer having the lower load pressure is controlled to open to such a degree that this load pressure difference is compensated.

* * * * *